US010967419B2

(12) United States Patent
Buttrick et al.

(10) Patent No.: US 10,967,419 B2
(45) Date of Patent: Apr. 6, 2021

(54) LOCKBOLT COLLAR FEEDER FOR SWAGING TOOL

(71) Applicant: The Boeing Company, Chicago, IL (US)

(72) Inventors: James Buttrick, Seattle, WA (US); Daniel Martin Sherick, Ravensdale, WA (US); Terrence J. Rowe, Seattle, WA (US)

(73) Assignee: The Boeing Company, Chicago, IL (US)

( * ) Notice: Subject to any disclaimer, the term of this patent is extended or adjusted under 35 U.S.C. 154(b) by 193 days.

(21) Appl. No.: 16/280,947

(22) Filed: Feb. 20, 2019

(65) Prior Publication Data

US 2020/0261967 A1 Aug. 20, 2020

(51) Int. Cl.

| | |
|---|---|
| ***B21J 15/32*** | (2006.01) |
| ***B21J 15/02*** | (2006.01) |
| ***B21J 15/10*** | (2006.01) |

(52) U.S. Cl.

CPC ..... *B21J 15/32* (2013.01); *B21J 15/022* (2013.01); *B21J 15/105* (2013.01)

(58) Field of Classification Search

CPC ..... B21J 15/32; B21J 15/022; B21J 15/105
See application file for complete search history.

(56) References Cited

U.S. PATENT DOCUMENTS 4,852,376 A * 8/1989 Suhov ..... B21J 15/32 29/812.5
9,511,416 B2 * 12/2016 Godfrey ..... B21J 15/326
9,586,257 B2 3/2017 Godfrey et al.
10,316,878 B2 * 6/2019 Suttles ..... B21J 15/022
2015/0184689 A1 * 7/2015 Godfrey ..... B21J 15/38 29/515
2018/0073539 A1 * 3/2018 Suttles ..... F16B 39/284

OTHER PUBLICATIONS

Gagebilt, Inc. "GB5500 Series Collar Feeder Installation for LGP® Lockbolts." The Collar Feeder presents any size LGP collar in the proper orientation every time, removes operators fingers from dangerous pinch points, speeds up production and saves you money. Demonstration video, retrieved on Nov. 19, 2018 from https://youtu.be/zjkSBMENJSY, uploaded to YouTube on Mar. 2, 2016.
Collar Feeder, Gage Bilt Inc. Retrieved from the internet https://aviationpros.com/product/12177808/gage-bilt-inc-collar-feeder on Aug. 14, 2018, 1 page.
Gage Bilt, GB5500 Series Collar Feeder. Product pamphlet, revised Dec. 2018, retrieved on Feb. 13, 2019, 2 pages.

* cited by examiner

*Primary Examiner* — Bayan Salone
(74) *Attorney, Agent, or Firm* — Kolisch Hartwell, P.C.

(57) ABSTRACT

A lockbolt collar feeder employing a resilient holder coupled to a linear actuator via a positioning arm, where the resilient holder can receive a lockbolt collar from a collar dispensing mechanism while disposed in a first position, and then when the linear actuator is extended the positioning arm extends and rotates the resilient holder to a second position in which the resilient holder can facilitate positioning the lockbolt collar onto a lockbolt for subsequent swaging. The linear actuator of the lockbolt collar feeder is configured to be coupled to a swaging tool, and thereby facilitates a method of positioning a lockbolt collar onto a lockbolt using the swaging tool.

20 Claims, 8 Drawing Sheets

LOCKBOLT COLLAR FEEDER FOR SWAGING TOOL

FIELD

This disclosure relates to tools for installing lockbolt fasteners. More specifically, this disclosure relates to lockbolt collar feeders suitable for use with swaging tools to facilitate the installation of collars onto lockbolt fasteners.

INTRODUCTION

Lockbolts are fasteners used where permanent, secure, and high strength assembly is required. Although outwardly similar to a bolt, a lockbolt employs annular grooves around the shaft (or pin) of the lockbolt rather than helical screw threads. During installation, after a lockbolt is placed into a preformed hole through the materials to be permanently joined and a lockbolt collar is placed on the shaft of the lockbolt. A special swaging tool is used to simultaneously apply tension to the lockbolt and deform (swage) the collar under high pressure, permanently locking the collar into place around the grooves on the lockbolt shaft. The extra portion of the lockbolt shaft beyond the collar, or pintail, which the swaging tool engaged to apply tension to the lockbolt is then broken off, leaving a permanent and secure lockbolt assembly.

Lockbolts provide an excellent alternative where construction requires a durable and long-lasting connection, as they provide high shear and tensile strength performance in load-bearing applications. Lockbolts do not loosen due to vibration, as may occur when using a conventional bolt and hex nut, and may be considered as permanent as a weld. Unlike welding, however, lockbolt installation requires no specialized skills, and can be accomplished rapidly and consistently. Lockbolts are widely used in the mining, container, construction, railway, and vehicle assembly industries, particularly in the manufacture of commercial aircraft.

Although providing many advantages, the installation of lockbolts in tight or cramped spaces may require an installer to wield the swaging tool in awkward and/or fatiguing position, and may be highly repetitive. Using a swaging tool to install lockbolts above the installer's head may be particularly fatiguing and ergonomically unfavorable.

SUMMARY

The present disclosure provides a lockbolt collar feeder employing a resilient holder coupled to a linear actuator via a positioning arm, where the resilient holder can receive a lockbolt collar from a collar dispensing mechanism while disposed in a first position, and then when the linear actuator is extended the positioning arm extends and rotates the resilient holder to a second position in which the resilient holder can facilitate positioning the lockbolt collar onto a lockbolt for subsequent swaging. The linear actuator of the lockbolt collar feeder is configured to be coupled to a swaging tool, and thereby facilitates a method of positioning a lockbolt collar onto a lockbolt using the swaging tool.

In some embodiments, the disclosure provides a lockbolt collar feeder for a swaging tool. The lockbolt collar feeder may include a linear actuator configured to be coupled to a swaging tool, a positioning arm coupled to an end of the linear actuator configured to rotate about the axis of the linear actuator as it extends from a retracted position to an extended position, and a resilient holder coupled to the end of the positioning arm that is configured to releasably receive and retain a collar to be positioned onto a lockbolt. The lockbolt collar feeder may be constructed so that when the linear actuator is retracted, the positioning arm rotates to a first collar-loading position that places the resilient holder adjacent to and aligned with a collar dispenser mechanism so that it can receive a collar from the collar dispenser mechanism. Additionally, when the linear actuator is extended, the positioning arm may be biased to rotate about the axis of the linear actuator to a second collar-installing position so that the resilient holder is distal to and in approximate alignment with the end of the swaging tool to facilitate positioning the collar onto the lockbolt. Subsequent retraction of the linear actuator after positioning the collar onto the lockbolt may cause the resilient holder to release the collar positioned on the lockbolt, and cause the positioning arm to return to the first collar-loading position, moving the resilient holder away from the end of the swaging tool and preventing interference with the operation of the swaging tool.

In some embodiments, the disclosure provides a swaging apparatus. The swaging apparatus may include a swaging tool having an upper end that includes tooling for swaging a lockbolt collar onto a lockbolt. In addition, the swaging apparatus may include a linear actuator coupled to the swaging tool in such a way that the extension axis of the linear actuator is parallel to the operational axis of the swaging tool. A positioning arm may be coupled to an end of the linear actuator and configured to rotate about the extension axis of the linear actuator as it extends from a retracted position to an extended position, with a resilient holder coupled to the end of the positioning arm that is configured to receive and releasably retain a collar for swaging onto a lockbolt. The swaging apparatus may be constructed so that when the linear actuator is retracted the positioning arm rotates to a first collar-loading position with the resilient holder adjacent to and aligned with a collar dispenser mechanism to receive a collar from the collar dispenser mechanism, and when the linear actuator is extended the positioning arm is biased to rotate to a second collar-installing position in which the resilient holder is distal to and in approximate alignment with the end of the swaging tooling to facilitate positioning the collar onto the lockbolt. Additionally, retraction of the linear actuator after positioning the collar onto the lockbolt may cause the resilient holder to release from the collar already positioned on the lockbolt, and causes the positioning arm to return to the first collar-loading position and moving the resilient holder away from the end of the swaging tool to prevent interference with the operation of the swaging tool.

In some embodiments, the disclosure provides a method of positioning a lockbolt collar onto a lockbolt, the method including feeding a lockbolt collar from a collar magazine to a resilient holder at the distal end of a positioning arm coupled to an end of a linear actuator, where the resilient holder is configured to receive and releasably retain the lockbolt collar; actuating the linear actuator to extend the positioning arm to an extended position in which the positioning arm rotates about the axis of the linear actuator to position the resilient holder distal to and in approximate alignment with an end of a swaging tool, to facilitate positioning the collar onto the lockbolt; placing the collar within the resilient holder onto the lockbolt; supporting the collar positioned on the lockbolt with the swaging tool; and retracting the linear actuator to cause the resilient holder to release from the collar and return the positioning arm to its initial position.

The disclosed features, functions, and advantages of the disclosed lockbolt collar feeder, swaging apparatus, and methods of positioning a lockbolt collar onto a lockbolt may be achieved independently in various embodiments of the present disclosure, or may be combined in yet other embodiments, further details of which can be seen with reference to the following description and drawings.

DESCRIPTION

Various aspects and examples of lockbolt collar feeders, swaging apparatus, and methods of positioning a lockbolt collar onto a lockbolt apparatus are described below and illustrated in the associated drawings. Unless otherwise specified, the disclosed apparatus and/or their various components may, but are not required to, contain one or more of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments will necessarily provide the same advantages or the same degree of advantages.

Figure 1:
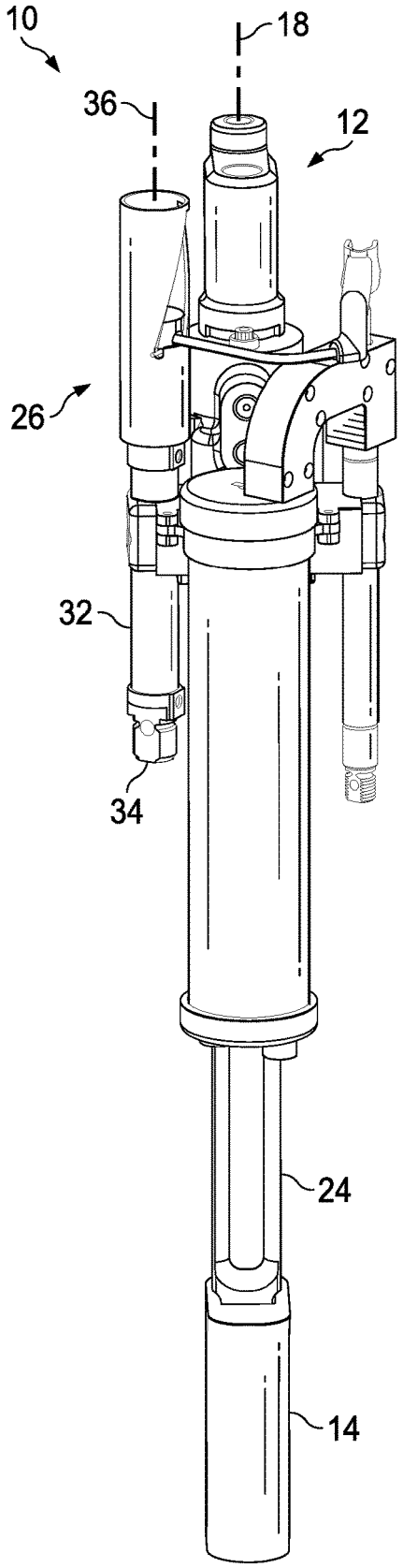
FIG. 1 depicts a rear view of an illustrative swaging apparatus according to an aspect of the present disclosure.
Figure 2:
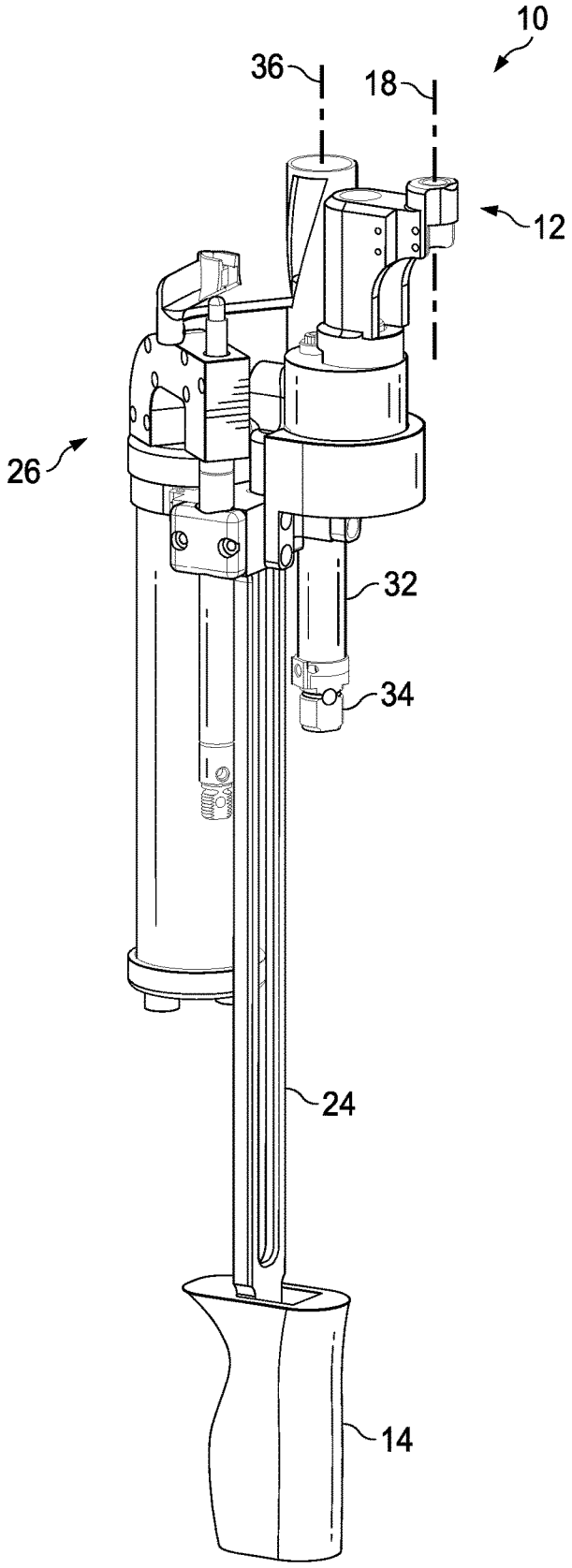
FIG. 2 depicts the right side of the swaging apparatus of FIG. 1.

FIGS. 1 and 2 depict a swaging apparatus 10 according to the present disclosure. Swaging apparatus 10 includes a swaging tool 12 coupled to a handle 14, where handle 14 may include controls for operating swaging apparatus 10.

Swaging tool 12 is configured to secure a lockbolt collar to an appropriate lockbolt. Any type of lockbolt swaging tool may be a suitable swaging tool according to the present disclosure. For example swaging tool 12 may be a hydraulic swaging tool, and include appropriate hydraulic connections. However, an appropriate swaging tool may alternatively be operable by pneumatic pressure, simple mechanical leverage, or any other operable means of applying force to the lockbolt collar.

Swaging tool 12 may define an operational axis 18, which is the axis along which force is applied to swage a lockbolt collar, and which is aligned during operation with the long axis 20 of the lockbolt 22 which is to be secured by swaging. Swaging tool 12, as exemplified herein, may include an operational axis that is substantially vertical, making it particularly useful for overhead operation. Similarly, handle 14 of swaging tool 12 may include a vertical extension 24 to further facilitate operation. The swaging apparatus as exemplified by the present disclosure may offer particular utility for lockbolt installation where the lockbolt is above the operator's head and/or under cramped conditions, but any appropriate handle and/or swaging tool orientation may be used in conjunction with the present disclosure, and may be selected depending upon the nature, the orientation, and the accessibility of the lockbolt and workpiece being secured, among other factors.

Swaging apparatus 10 may additionally include a lockbolt collar feeder 26 that is configured to position a lockbolt collar 28 distal to and in approximate alignment with a distal end 30 of swaging tool 12 in order to facilitate positioning of lockbolt collar 28 onto lockbolt 22 for subsequent swaging.

Lockbolt collar feeder 26 may include a linear actuator 32 that is configured to be coupled to swaging tool 12. A linear actuator is an actuator configured to create motion, and in particular reciprocal motion along a straight line. The straight line defined by the motion of a linear actuator may be referred to as the extension axis of the linear actuator. Linear actuator 32 may be any type of linear actuator, including mechanical, hydraulic, pneumatic, piezoelectric, electro-mechanical, among others. In one aspect of the present disclosure, linear actuator 32 may be pneumatically-activated and may include a connection 34 for a high-pressure gas supply to operate linear actuator 32.

In one aspect of the present disclosure, lockbolt collar feeder 26 may be configured to be attached to swaging tool 12 so that an extension axis 36 of linear actuator 32 is at least substantially parallel to operational axis 18 of swaging tool 12. As shown in FIGS. 1 and 2 extension axis 36 and operational axis 18 may each be substantially parallel to vertical handle extension 24 of handle 14.

Figure 3:
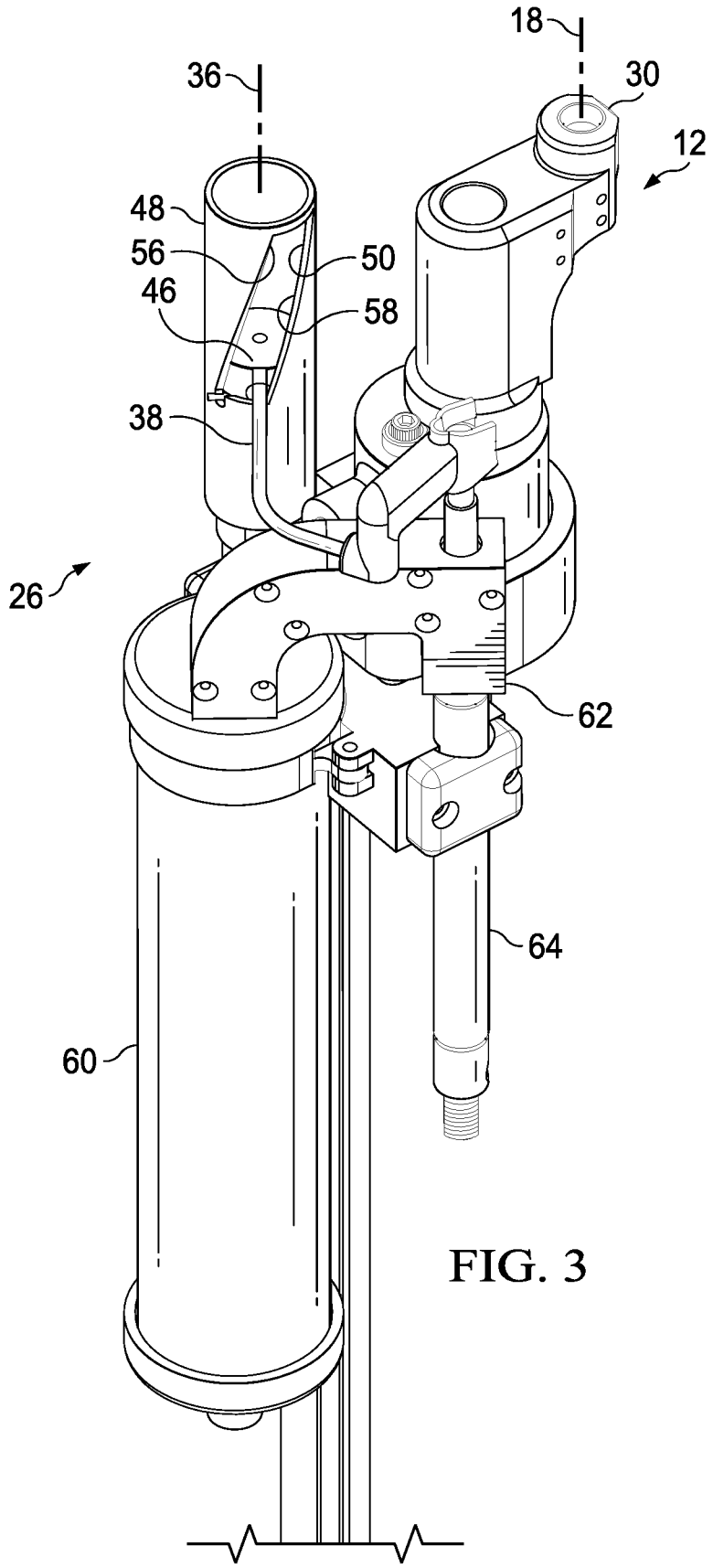
FIG. 3 is a perspective view of the lockbolt collar feeder and swaging tool of the swaging apparatus of FIG. 1, with the linear actuator of the collar feeder in a retracted position.
Figure 4:
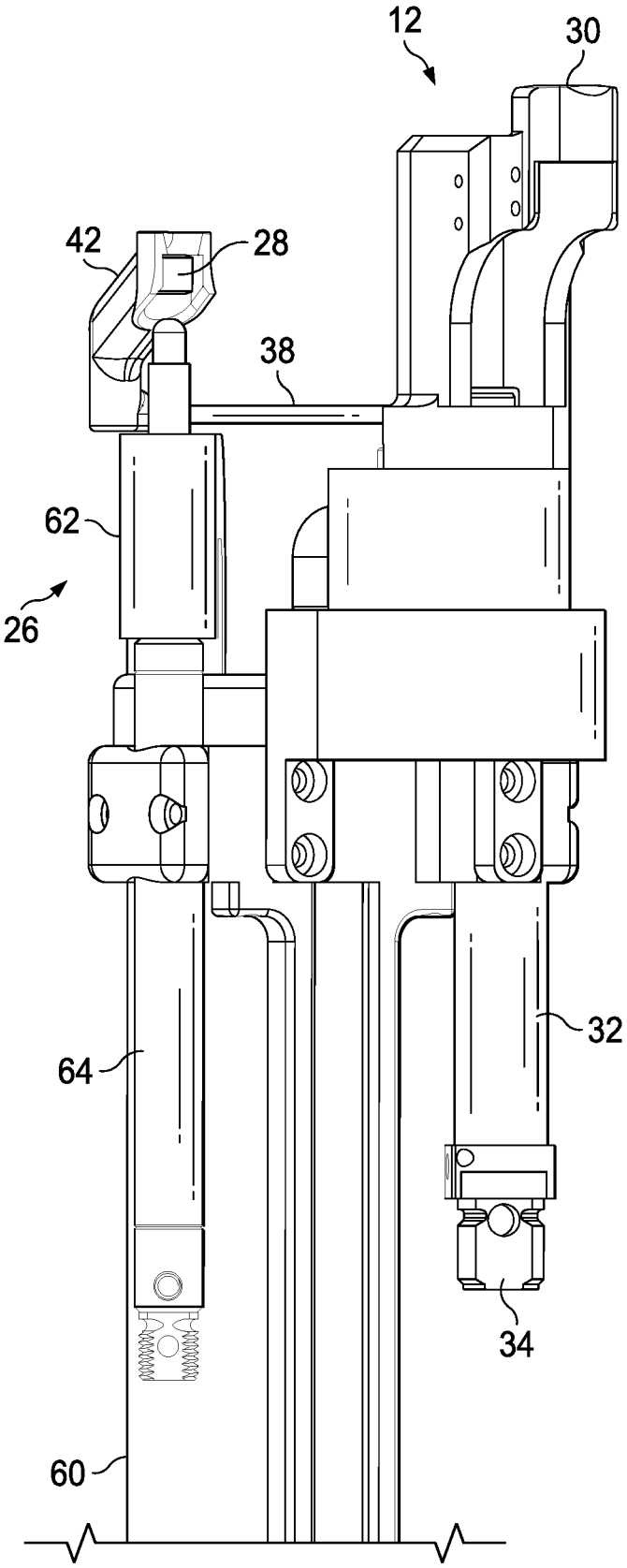
FIG. 4 is an alternative view of the lockbolt collar feeder and swaging tool of FIG. 3.
Figure 5:
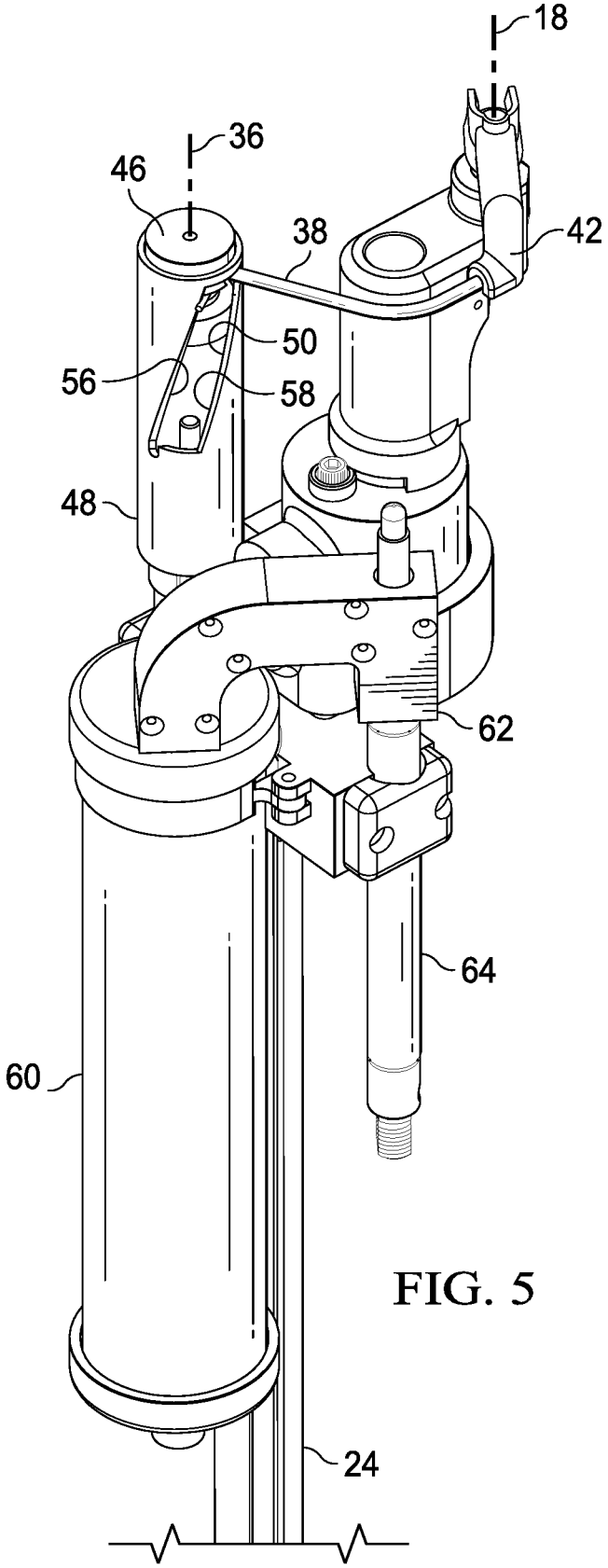
FIG. 5 is a perspective view of the lockbolt collar feeder and swaging tool of the swaging apparatus of FIG. 1, with the linear actuator of the collar feeder in an extended position.
Figure 6:
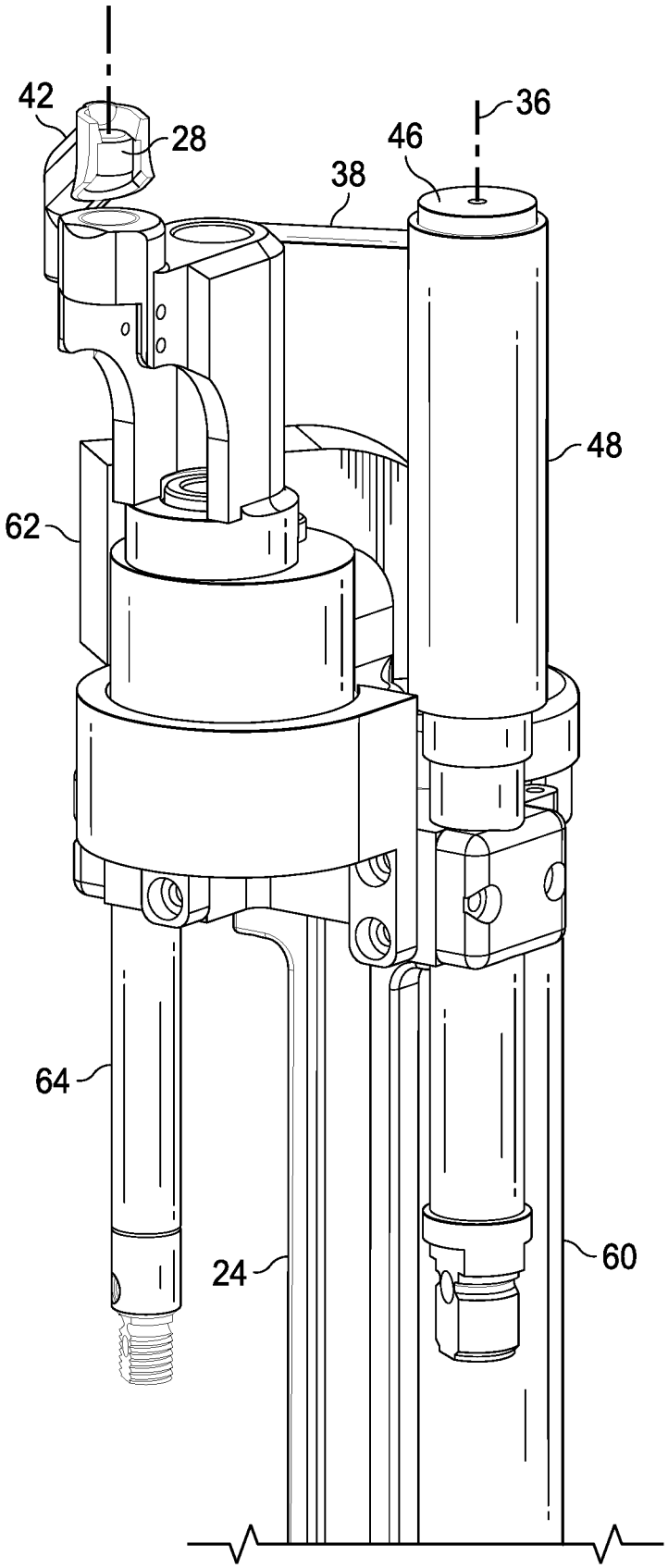
FIG. 6 is an alternative view of the lockbolt collar feeder and swaging tool of FIG. 5.
Figure 7:
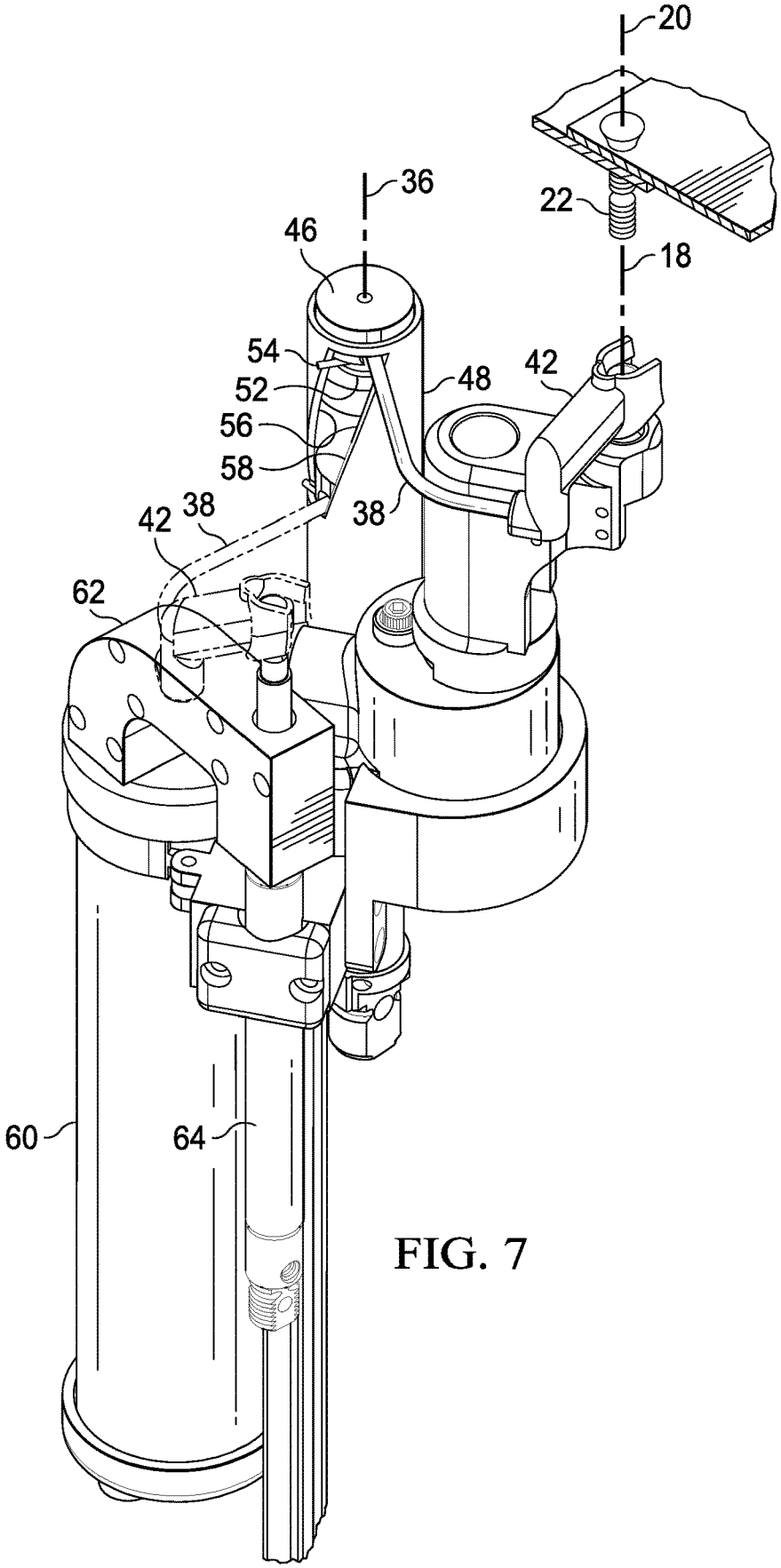
FIG. 7 depicts the swaging apparatus of FIG. 1, showing the first and second positions of the resilient lockbolt collar holder.

Lockbolt collar feeder 26 may additionally include a positioning arm 38 coupled to a distal end of linear actuator 32. A resilient lockbolt collar holder 42 may, in turn, be coupled to a distal end of positioning arm 38. Positioning arm 38 may be configured so that as linear actuator 32 extends from a first retracted position (as shown in FIGS. 3 and 4) to a second and extended position (as shown in FIGS. 5 and 6), positioning arm 38 may simultaneously rotate around extension axis 36 as linear actuator 32 extends. FIG. 7 depicts swaging apparatus 10 with positioning arm 38 and resilient lockbolt collar holder 42 in the first retracted position (in dashed lines) and in the second extended position (in solid lines).

Once extended, linear actuator 32 may be returned to its first retracted position either by reversing the extension process, such as where linear actuator 32 is a mechanical actuator, or by the action of a biasing mechanism that urges reciprocating member 46 in the proximal direction unless linear actuator 32 is actively energized.

Figure 8:
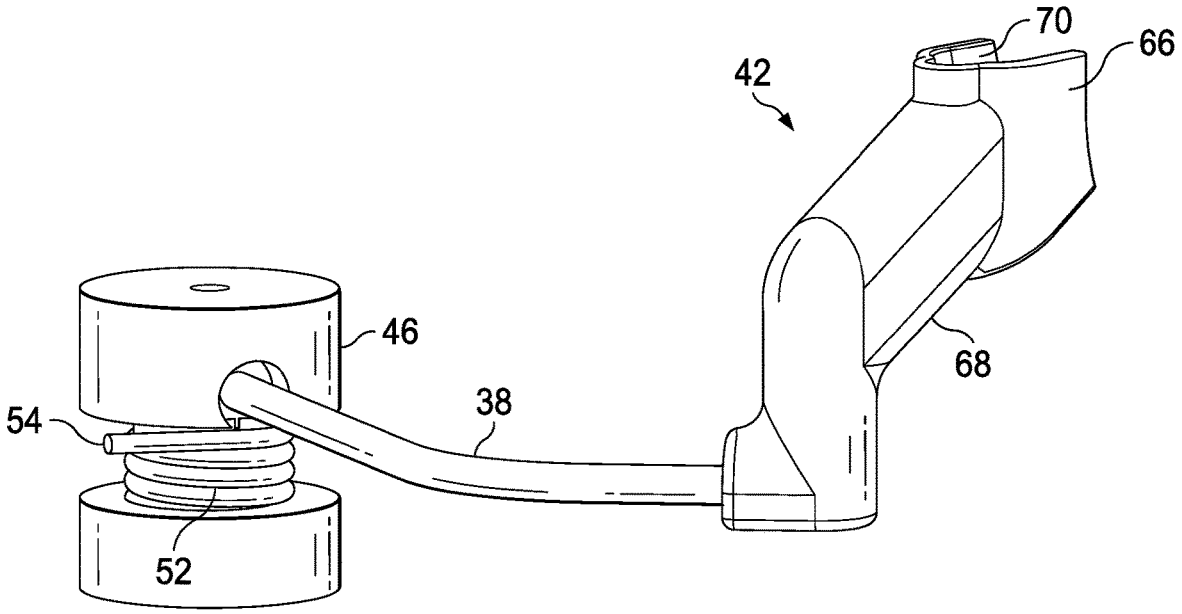
FIG. 8 depicts the resilient lockbolt collar holder, positioning arm, and sliding cam of the swaging apparatus of claim 1.
Figure 9:
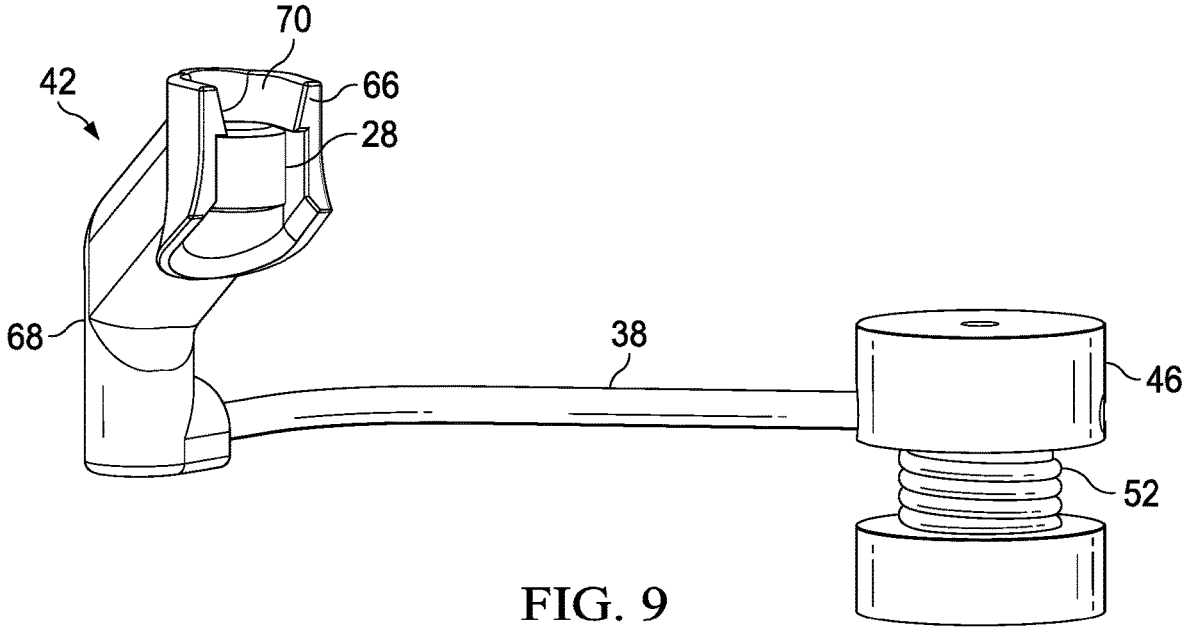
FIG. 9 depicts the resilient lockbolt collar holder and positioning arm of the swaging apparatus of claim 1.
Figure 10:
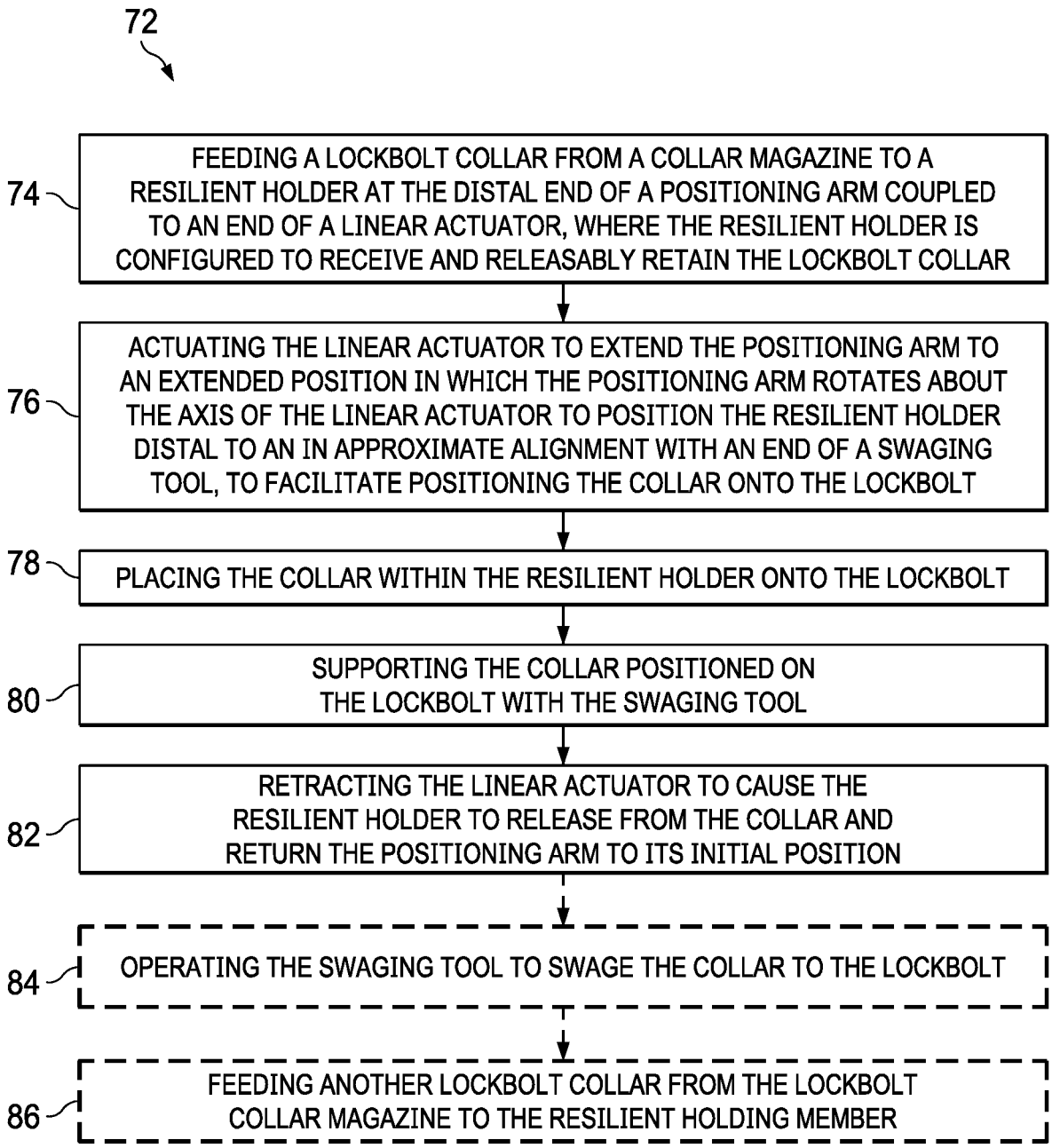
FIG. 10 is a flowchart setting out an illustrative method of positioning a lockbolt collar onto a lockbolt, according to an aspect of the present disclosure.

The rotational motion of positioning arm 38 may be effected by attaching positioning arm 38 to a reciprocating member 46 as shown in FIGS. 8 and 9. Reciprocating member 46 may be pivotally coupled to the distal end of linear actuator 32, and disposed within a cylindrical sleeve 48 that is concentric with extension axis 36 of linear actuator 32. Cylindrical sleeve 48 may define a helical guide slot 50. Positioning arm 38 may extend from reciprocating member 46 through guide slot 50, such that guide slot 50 serves as a cylindrical cam for positioning arm 38, which in turn functions as a cam follower. Therefore as linear actuator 32 extends, reciprocating member 46 moves toward the distal end of cylindrical sleeve 48, and positioning arm 38 rotates around extension axis 36 as it interacts with guide slot 50.

Alternatively, or in addition, reciprocating member 46 may be coupled with a biasing mechanism such as torsion spring 52, where a projecting end 54 of torsion spring 52 may extend through guide slot 50, so that as projecting end 54 follows a first edge 56 of guide slot 50 in cylindrical sleeve 48, positioning arm 38 is continuously urged against the second and opposing edge 58 of guide slot 50. As a result, positioning arm 38 exhibits a degree of rotational freedom due to compression of torsion spring 52, which may in turn facilitate alignment of resilient holder 42 with a lockbolt during operation of swaging apparatus 10.

In one aspect of the present disclosure, positioning arm 38 extends in a plane that is substantially orthogonal to both operational axis 18 and extension axis 36. At the same time, positioning arm 38 may be inwardly curved. That is, positioning arm 38 may include some degree of curvature that is generally inward, or toward the center of swaging apparatus 10. The incorporation of an inward curve may minimize the required cross-sectional operating area of swaging apparatus 10, making it possible to more easily attach lockbolt collars in cramped spaces.

Swaging apparatus 10 additionally may include a lockbolt collar magazine 60 that is configured to store a lockbolt collar supply of a plurality of lockbolt collars. Coupled to lockbolt collar magazine 60 may be a lockbolt collar dispensing mechanism 62 configured so that when activated, lockbolt collar dispensing mechanism 62 dispenses a single lockbolt collar 28 at a time from lockbolt collar magazine 60. Each time lockbolt collar dispensing mechanism 62 is activated, it may dispense another lockbolt collar, in sequence, until lockbolt collar magazine 60 is empty.

In one aspect of the present disclosure, lockbolt collar dispensing mechanism 62 includes an air actuator 64 that is configured to transfer a lockbolt collar 28 from lockbolt collar dispensing mechanism 62 to gripping portion 66 of resilient holder 42 when positioning arm 38 is in the first position. Air actuator 64 is optionally configured to transfer a lockbolt collar from lockbolt collar dispensing mechanism to gripping portion 66 automatically upon retraction of linear actuator 32. That is, upon retraction of linear actuator 32 and the concomitant return of positioning arm 38 to its first collar-loading position, air actuator 64 automatically transfers a lockbolt collar to gripping portion 66 and swaging apparatus 10 is then ready to install another lockbolt collar.

Resilient holder 42 may be configured to receive and releasably retain a lockbolt collar for swaging onto a lockbolt. In particular, lockbolt collar dispensing mechanism 62 may be positioned and oriented so that when linear actuator 32 is in its first, retracted position and positioning arm 38 is therefore disposed in its first position, lockbolt collar dispensing mechanism 62 is adjacent to and substantially aligned with resilient holder 42, so that lockbolt collar dispensing mechanism 62 can transfer a single lockbolt collar 28 from the collar supply of lockbolt collar magazine 60 to resilient holder 42, where it is releasably retained.

As linear actuator 32 is activated, and positioning arm 38 simultaneously extends distally and rotates about extension axis 36 into its second and extended position, lockbolt collar 28 (while being releasably retained by resilient holder 42) is moved to a position that is distal to and substantially aligned with distal end 30 of swaging tool 12. In this extended configuration, lockbolt collar 28 can readily be placed onto and around lockbolt 22 by an operator of swaging apparatus 10.

While positioning arm 38 is in its extended position lockbolt collar 28 may be retained by resilient holder 42 even as lockbolt 22 is inserted into lockbolt collar 28, which may aid in positioning lockbolt collar 28 for the operator. Once the operator of swaging apparatus 10 urges swaging tool 12 against lockbolt collar 22 in preparation for swaging the collar, however, linear actuator 32 may be retracted. As positioning arm 38 retracts and pivots around extension axis 36, lockbolt collar 28 remains on lockbolt 22 where it is retained in position by the presence of swaging tool 12. The retraction of resilient holder 42 may prevent interference by resilient holder 42 with the operation of swaging tool 12, so the operator may activate swaging tool 12 and install the lockbolt collar onto the lockbolt. At the same time, retraction of linear actuator 32 returns resilient holder 42 to a position where it can receive another lockbolt collar from lockbolt collar dispensing mechanism 62.

In one aspect of the present disclosure, resilient holder 42 may include a gripping portion 66 that is configured to releasably retain lockbolt collar 28 and a support portion 68 that attaches gripping portion 66 to positioning arm 38. In particular, as shown in FIGS. 7 and 8, resilient holder 42 may include a gripping portion 66 that may be shaped, contoured, and configured to accept and releasably retain lockbolt collar 28. In one aspect of the present disclosure, gripping portion 66 may be sufficiently resilient to deform slightly with pressure, so that when lockbolt collar dispensing mechanism 62 urges lockbolt collar 28 against gripping portion 66, gripping portion 66 may flex to accept the lockbolt collar, and then return to its original shape in order to retain lockbolt collar 28. Gripping portion 66 should however also be flexible enough that once lockbolt collar 28 is disposed on lockbolt 22, gripping portion 66 readily flexes sufficiently to release lockbolt collar 28 threaded onto lockbolt 22 as positioning arm 38 retracts.

Either resilient holder 42 or gripping portion 66 may be configured to be readily exchanged for a resilient holder 42 or gripping portion 66 that is configured to accept and releasably retain a lockbolt collar having a different size or configuration. Preferably the resilient holder 42 is configured so that such an exchange may be performed quickly and with few or no tools required.

In one aspect of the present disclosure, gripping portion 66 of resilient holder 42 includes a C-shape, as shown in particular in FIGS. 7 and 8. In another aspect of the present disclosure, gripping portion 66 includes a beveled upper opening 70 that facilitates placement of lockbolt collar 28 onto lockbolt 22 as it is retained by gripping portion 66.

Support portion 68 of resilient holder 42 serves to attach gripping portion 66 to positioning arm 38, and also to position gripping portion 66 appropriately to both receive a lockbolt collar from lockbolt collar dispensing mechanism 62 when positioning arm 38 is in its first position, and to install a lockbolt collar onto a lockbolt when positioning arm 38 is in its second position. In one aspect of the present disclosure, support portion 68 may be sufficiently compliant that the position of gripping portion 66 with respect to positioning arm 38 is at least substantially adjustable, thereby facilitating the positioning of lockbolt collar 28 onto lockbolt 22 as the collar is retained by gripping portion 66, and aligning lockbolt collar 28 with distal end 30 of swaging tool 12.

Unlike rigid extendable feeder mechanisms, positioning arm 38 of the present disclosure rotates about extension axis 36 of linear actuator 32 to its second and extended position (due to torsion spring 52 urging rotation of positioning arm 38), in which the positioning arm 38 is compliant and able to rotate about the extension axis against the torsion spring 52 when positioning a lockbolt collar 28 in the holder 42 onto a lockbolt 22, to provide sufficient rotational freedom to facilitate alignment of the lockbolt collar 28 in resilient holder 42 with a lockbolt 22. Positioning arm 38, when in the second and extended position, may be configured to rotate, for example, as much as 45 degrees (3-4 inches) about extension axis 36 of linear actuator 32 to enable positioning arm 38 and resilient holder 42 to be momentarily moved out of alignment with distal end 30 of swaging tool 12 for compliant movement and positioning of lockbolt collar 28 relative to the end of lockbolt 22, to thereby enable positioning and insertion of lockbolt collar 28 on lockbolt 22 when it is located in confined, hard-to-reach areas.

In order to exhibit the desired resilience and flexibility, one or more of gripping portion 66 and support portion 68 may include an appropriately flexible yet resilient material such as a natural or synthetic polymer material. In one aspect of the present disclosure, one or more of gripping portion 66 and support portion 68 of resilient holder 42 is at least somewhat translucent, in order to provide a visual guide to aligning a retained lockbolt collar onto a lockbolt. Suitable polymer materials may include natural or synthetic rubbers, elastomers, or plastics. In an aspect of the present disclosure, one or more of gripping portion 66 and support portion 68 includes a polymer material that is polyethylene terephthalate (PET) or NYLON-66. A variety of suitable resilient materials are commercially available, and a resilient material that possesses the desirable strength, flexibility, durability, and optionally translucence for use in forming the gripping portion 66 and/or support portion 68 of resilient holder 42 may be readily identified. In one aspect of the present disclosure, both gripping portion 66 and support portion 68 may be portions of a single and unitary resilient holder 42 formed from a selected resilient material.

Swaging apparatus 10 may be configured so that the controls for operating various mechanisms of the apparatus are disposed on or near the lower end of swaging tool 12. In particular, operating controls for one or more of the components of swaging apparatus 10 may be disposed on or near handle 14, in order to facilitate operation of the apparatus by the operator. In one aspect of the present disclosure, handle 14 may include controls for operating swaging tool 12. In another aspect of the present disclosure, handle 14 may include controls for operating lockbolt collar feeder 26. The controls for operating lockbolt collar feeder 26 may include a single, combined control. Alternatively, the controls for operating lockbolt collar feeder 26 may include separate controls for activating linear actuator 32 and air actuator 64. In one aspect of the present disclosure, swaging apparatus 10 may be operated using two controls, a first press-to-operate control that actuates linear actuator 32, where releasing the control retracts linear actuator 32, and a second control to activate swaging tool 12.

The swaging apparatus of the present disclosure lends itself to a method of positioning a lockbolt collar onto a lockbolt, as set out in flowchart 72 of FIG. 9. The disclosed method includes feeding a lockbolt collar from a collar magazine to a resilient holder at the distal end of a positioning arm coupled to an end of a linear actuator, where the resilient holder is configured to receive and releasably retain the lockbolt collar, at step 74 of flowchart 72; actuating the linear actuator to extend the positioning arm to an extended position in which the positioning arm rotates about the axis of the linear actuator to position the resilient holder distal to and in approximate alignment with an end of a swaging tool, to facilitate positioning the collar onto the lockbolt, at step 76 of flowchart 72; placing the collar within the resilient holder onto the lockbolt, at step 78 of flowchart 72; supporting the collar positioned on the lockbolt with the swaging tool, at step 80 of flowchart 72; and retracting the linear actuator to cause the resilient holder to release from the collar and return the positioning arm to its initial position, at step 82 of flowchart 72.

In one aspect of the present disclosure, the method of flowchart 72 optionally further includes operating the swaging tool to swage the collar to the lockbolt, at step 84 of flowchart 72. In another aspect of the present disclosure, the method of flowchart 72 optionally further includes feeding another lockbolt collar from the lockbolt collar magazine to the resilient holding member, at step 86 of flowchart 72.

Swaging apparatus 10, as presently disclosed, offers particular advantages where the lockbolt to be secured is disposed above an operator of swaging tool 12, and placing the lockbolt collar upon the lockbolt occurs over the operator's head. In a particular aspect of the method of flowchart 72, the step of placing the lockbolt collar within the resilient holder upon the lockbolt includes employing the compliancy of the support portion to movably adjust a position of the gripping portion with respect to the positioning arm in order to facilitate the positioning of the collar onto the lockbolt.

Examples, Components, and Alternatives

The following numbered paragraphs describe selected aspects of the disclosed lockbolt collar feeders, swaging apparatus, and methods of positioning a lockbolt collar onto a lockbolt. The examples in these sections are intended for illustration and should not be interpreted as limiting the entire scope of the present disclosure. Each section may include one or more distinct embodiments or examples, and/or contextual or related information, function, and/or structure.

A1. A lockbolt collar feeder for a swaging tool, comprising a linear actuator configured to be coupled to the swaging tool; a positioning arm coupled to an end of the linear actuator and configured to rotate about an axis of the linear actuator as the linear actuator extends from a retracted position to an extended position; a resilient holder coupled to a distal end of the positioning arm and configured to releasably receive and releasably retain a collar to be positioned onto a lockbolt; wherein when the linear actuator is retracted the positioning arm rotates to a first collar-loading position in which the resilient holder is adjacent to and aligned with a collar dispensing mechanism to receive the collar from the collar dispensing mechanism, and when the linear actuator is extended the positioning arm is biased to rotate about the axis of the linear actuator to a second collar-installing position in which the resilient holder is distal to and in approximate alignment with the end of the swaging tool to facilitate positioning the collar onto the lockbolt; and retraction of the linear actuator after positioning the collar onto the lockbolt causes the resilient holder to release from the collar positioned on the lockbolt, and causes the positioning arm to return to the first collar-loading position, thereby moving the resilient holder away from the end of the swaging tool for preventing interference with operation of the swaging tool.

A2. The lockbolt collar feeder of paragraph A1, wherein the positioning arm is biased by a torsion spring so that the positioning arm is urged toward the second collar-installing position.

A3. The lockbolt collar feeder of paragraph A1, wherein the resilient holder includes a gripping portion configured to releasably retain the collar and a support portion attaching the gripping portion to the positioning arm; wherein the support portion is sufficiently compliant that the position of the gripping portion with respect to the positioning arm is adjustable, facilitating the positioning of the collar retained by the gripping portion onto the lockbolt, and aligning the collar with the end of the swaging tool.

A4. The lockbolt collar feeder of paragraph A1, wherein the gripping portion of the resilient holder is configured to receive and releasably retain a collar from the collar dispensing mechanism.

A5. The lockbolt collar feeder of paragraph A1, wherein the collar feeder is configured to be attached to the swaging tool in such a way that an extension axis of the linear actuator is parallel to the operational axis of the swaging tool.

A6. The lockbolt collar feeder of paragraph A5, wherein when the linear actuator is extended, as the positioning arm moves from the first position to the second position the resilient holder moves along the extension axis of the linear actuator as well as rotationally around the extension axis of the linear actuator.

B1. A swaging apparatus, comprising a swaging tool having an upper end including tooling for swaging a lockbolt collar onto a lockbolt; a linear actuator coupled to the swaging tool such that an extension axis of the linear actuator is parallel to an operational axis of the swaging tool; a positioning arm coupled to an end of the linear actuator and configured to rotate about an extension axis of the linear actuator as the linear actuator extends from a retracted position to an extended position; a resilient holder coupled to a distal end of the positioning arm and configured to receive and releasably retain a collar for swaging onto a lockbolt; wherein when the linear actuator is retracted the positioning arm rotates to a first collar-loading position in which the resilient holder is adjacent to and aligned with a collar dispensing mechanism to receive the collar from the collar dispensing mechanism, and when the linear actuator is extended the positioning arm is biased to rotate to a second collar-installing position in which the resilient holder is distal to and in approximate alignment with the end of the swaging tooling to facilitate positioning the collar onto the lockbolt, and retraction of the linear actuator after positioning the collar onto the lockbolt causes the resilient holder to release from the collar positioned on the lockbolt and causes the positioning arm to return to the first collar-loading position, thereby moving the resilient holder away from the end of the swaging tool for preventing interference with operation of the swaging tool.

B2. The swaging apparatus of paragraph B1, wherein a lower end of the swaging tool includes a control for operating the linear actuator and a control for operating the swaging tooling.

B3. The swaging apparatus of paragraph B1, wherein the positioning arm is inwardly curved to minimize a required cross-sectional operating area.

B4. The swaging apparatus of paragraph B1, wherein operation of the linear actuator is air-actuated, and operation of the swaging tooling is a hydraulically-actuated.

B5. The swaging apparatus of paragraph B1, wherein the positioning arm is biased by a torsion spring so that the positioning arm is urged toward the second collar-installing position; and the resilient holder includes a gripping portion configured to releasably retain the collar and a support portion attaching the gripping portion to the positioning arm.

B6. The swaging apparatus of paragraph B5, wherein the support portion of the resilient holder is sufficiently compliant that the position of the gripping portion with respect to the positioning arm is adjustable, thereby facilitating the positioning of the collar retained by the gripping portion onto the lockbolt, and aligning the collar with the end of the swaging tool.

B7. The swaging apparatus of paragraph B5, further comprising an air actuator configured to transfer a collar from the collar dispensing mechanism to the gripping portion of the resilient holder when the positioning arm is in the first position.

B8. The swaging apparatus of paragraph B7, wherein the air actuator configured to transfer a collar from the collar dispensing mechanism to the gripping portion of the resilient holder operates automatically upon retraction of the linear actuator.

B9. The swaging apparatus of paragraph B5, wherein the gripping portion of the resilient holder includes a beveled upper opening configured to facilitate placement of the collar retained by the gripping portion onto the lockbolt.

C1. A method of positioning a lockbolt collar onto a lockbolt, comprising: feeding a lockbolt collar from a collar magazine to a resilient holder at a distal end of a positioning arm coupled to an end of a linear actuator, where the resilient holder is configured to receive and releasably retain the lockbolt collar; actuating the linear actuator to extend the positioning arm to an extended position in which the positioning arm rotates about an axis of the linear actuator to position the resilient holder distal to and in approximate alignment with an end of a swaging tool, to facilitate positioning the collar onto the lockbolt; placing the collar within the resilient holder onto the lockbolt; supporting the collar positioned on the lockbolt with the swaging tool; and retracting the linear actuator to cause the resilient holder to release from the collar and return the positioning arm to its initial position.

C2. The method of paragraph C1, further comprising operating the swaging tool to swage the collar to the lockbolt.

C3. The method of paragraph C1, further comprising feeding another collar from the collar magazine to the resilient holding member.

C4. The method of paragraph C1, where the lockbolt is disposed above an operator of the swaging tool, and the step of placing the collar upon the lockbolt occurs over the operator's head.

C5. The method of paragraph C1, wherein the resilient holder includes a gripping portion configured to releasably retain the collar and a compliant support portion attaching the gripping portion to the positioning arm; and the step of placing the collar within the resilient holder upon the lockbolt includes employing compliancy of the support portion to movably adjust a position of the gripping portion with respect to the positioning arm in order to facilitate the positioning of the collar onto the lockbolt.

Advantages, Features, Benefits

The different embodiments and examples of the tools, apparatus, and methods described herein for installing lockbolt collars provide several advantages over known tooling for installing lockbolt collars.

A large number of lockbolts are used in the construction of commercial aircraft, and a great many of those lockbolt collars are installed by hand. After a lockbolt is inserted into a preformed hole from an opposing side, a worker must slip a collar over the lockbolt, and then engage a collar swaging tool to complete the collar installation. During horizontal wing assembly, in particular, workers may be required to install thousands of lockbolt collars into the wing while it is overhead. In addition, such installations typically require that they constantly use both hands; one hand to slip lockbolt collars onto lockbolts, and the other to operate a lockbolt swaging tool. In addition to the repetitive nature of the work, the need to constantly reach overhead creates additional stresses and strains.

Additionally, although some lockbolt collar feeding tools have been developed, they typically also require both hands to operate. In addition, most are too large and too rigid to be used in close quarters, are difficult to reload, or are overly complex in operation.

The presently disclosed tools, apparatus, and methods permit the easy and rapid installation of large numbers of lockbolt collars, as the lockbolt collars may be supplied from large capacity magazines, and activation of the feeder mechanism easily moves a lockbolt collar from magazine to installation position, where it is aligned with the swaging tool. Additionally, the vertical configuration of the exemplary disclosed swaging apparatus permits lockbolt collars to be installed overhead, repeatedly, without the operator needing to raise his arms, while the compact design and minimal cross-sectional profile minimizes interference between the swaging apparatus and the workpiece, or adjacent fasteners.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A lockbolt collar feeder for a swaging tool, comprising:

a linear actuator configured to be coupled to the swaging tool;

a positioning arm coupled to an end of the linear actuator and configured to rotate about an axis of the linear actuator as the linear actuator extends from a retracted position to an extended position;

a resilient holder coupled to a distal end of the positioning arm and configured to releasably receive and releasably retain a collar to be positioned onto a lockbolt;

wherein when the linear actuator is retracted the positioning arm rotates to a first collar-loading position in which the resilient holder is adjacent to and aligned with a collar dispensing mechanism to receive the collar from the collar dispensing mechanism, and when the linear actuator is extended the positioning arm is biased to rotate about the axis of the linear actuator to a second collar-installing position in which the resilient holder is distal to and in approximate alignment with the end of the swaging tool to facilitate positioning the collar onto the lockbolt; and retraction of the linear actuator after positioning the collar onto the lockbolt causes the resilient holder to release from the collar positioned on the lockbolt, and causes the positioning arm to return to the first collar-loading position, thereby moving the resilient holder away from the end of the swaging tool for preventing interference with operation of the swaging tool.

2. The lockbolt collar feeder of claim 1, wherein the positioning arm is biased by a torsion spring so that the positioning arm is urged toward the second collar-installing position.

3. The lockbolt collar feeder of claim 1, wherein the resilient holder includes a gripping portion configured to releasably retain the collar and a support portion attaching the gripping portion to the positioning arm;

wherein the support portion is sufficiently compliant that the position of the gripping portion with respect to the positioning arm is adjustable, facilitating the positioning of the collar retained by the gripping portion onto the lockbolt, and aligning the collar with the end of the swaging tool.

4. The lockbolt collar feeder of claim 3, wherein the gripping portion of the resilient holder is configured to receive and releasably retain a collar from the collar dispensing mechanism.

5. The lockbolt collar feeder of claim 1, wherein the collar feeder is configured to be attached to the swaging tool in such a way that an extension axis of the linear actuator is parallel to an operational axis of the swaging tool.

6. The lockbolt collar feeder of claim 5, wherein when the linear actuator is extended, as the positioning arm moves from the first position to the second position the resilient holder moves along the extension axis of the linear actuator as well as rotationally around the extension axis of the linear actuator.

7. A swaging apparatus, comprising:

a swaging tool having an upper end including tooling for swaging a lockbolt collar onto a lockbolt;

a linear actuator coupled to the swaging tool such that an extension axis of the linear actuator is parallel to an operational axis of the swaging tool;

a positioning arm coupled to an end of the linear actuator and configured to rotate about the extension axis of the linear actuator as the linear actuator extends from a retracted position to an extended position;

a resilient holder coupled to a distal end of the positioning arm and configured to receive and releasably retain a collar for swaging onto a lockbolt;

wherein when the linear actuator is retracted the positioning arm rotates to a first collar-loading position in which the resilient holder is adjacent to and aligned with a collar dispensing mechanism to receive the collar from the collar dispensing mechanism, and when the linear actuator is extended the positioning arm is biased to rotate to a second collar-installing position in which the resilient holder is distal to and in approximate alignment with the end of the swaging tooling to facilitate positioning the collar onto the lockbolt, and retraction of the linear actuator after positioning the collar onto the lockbolt causes the resilient holder to release from the collar positioned on the lockbolt and causes the positioning arm to return to the first collar-loading position, thereby moving the resilient holder away from the end of the swaging tool for preventing interference with the operation of the swaging tool.

8. The swaging apparatus of claim 7, wherein a lower end of the swaging tool includes a control for operating the linear actuator and a control for operating the swaging tooling.

9. The swaging apparatus of claim 7, wherein the positioning arm is inwardly curved to minimize a required cross-sectional operating area.

10. The swaging apparatus of claim 7, wherein operation of the linear actuator is air-actuated, and operation of the swaging tooling is hydraulically-actuated.

11. The swaging apparatus of claim 7, wherein the positioning arm is biased by a torsion spring so that the positioning arm is urged toward the second collar-installing position; and the resilient holder includes a gripping portion configured to releasably retain the collar and a support portion attaching the gripping portion to the positioning arm.

12. The swaging apparatus of claim 11, wherein the support portion of the resilient holder is sufficiently compliant that the position of the gripping portion with respect to the positioning arm is adjustable, thereby facilitating the positioning of the collar retained by the gripping portion onto the lockbolt, and aligning the collar with the end of the swaging tool.

13. The swaging apparatus of claim 11, further comprising an air actuator configured to transfer a collar from the collar dispensing mechanism to the gripping portion of the resilient holder when the positioning arm is in the first position.

14. The swaging apparatus of claim 13, wherein the air actuator configured to transfer a collar from the collar dispensing mechanism to the gripping portion of the resilient holder operates automatically upon retraction of the linear actuator.

15. The swaging apparatus of claim 11, wherein the gripping portion of the resilient holder includes a beveled upper opening configured to facilitate placement of the collar retained by the gripping portion onto the lockbolt.

16. A method of positioning a lockbolt collar onto a lockbolt, comprising:

feeding a lockbolt collar from a collar magazine to a resilient holder at a distal end of a positioning arm coupled to an end of a linear actuator, where the resilient holder is configured to receive and releasably retain the lockbolt collar;

actuating the linear actuator to extend the positioning arm to an extended position in which the positioning arm rotates about an axis of the linear actuator to position the resilient holder distal to and in approximate alignment with an end of a swaging tool, to facilitate positioning the collar onto the lockbolt;

placing the collar within the resilient holder onto the lockbolt;

supporting the collar positioned on the lockbolt with the swaging tool; and retracting the linear actuator to cause the resilient holder to release from the collar and return the positioning arm to its initial position.

17. The method of claim 16, further comprising operating the swaging tool to swage the collar to the lockbolt.

18. The method of claim 16, further comprising feeding another collar from the collar magazine to the resilient holding member.

19. The method of claim 16, where the lockbolt is disposed above an operator of the swaging tool, and the step of placing the collar upon the lockbolt occurs over the operator's head.

20. The method of claim 16, wherein the resilient holder includes a gripping portion configured to releasably retain the collar and a compliant support portion attaching the gripping portion to the positioning arm; and the step of placing the collar within the resilient holder upon the lockbolt includes employing compliancy of the support portion to movably adjust a position of the gripping portion with respect to the positioning arm in order to facilitate the positioning of the collar onto the lockbolt.

* * * * *